US006782234B2

(12) United States Patent
Takami

(10) Patent No.: US 6,782,234 B2
(45) Date of Patent: Aug. 24, 2004

(54) IMAGE FORMING APPARATUS

(75) Inventor: Nobuo Takami, Kawasaki (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/163,528

(22) Filed: Jun. 7, 2002

(65) Prior Publication Data

US 2003/0007815 A1 Jan. 9, 2003

(30) Foreign Application Priority Data

Jun. 7, 2001 (JP) ..... 2001-172071

(51) Int. Cl.[7] ..... G03G 21/10
(52) U.S. Cl. ..... 399/359; 347/115; 399/360
(58) Field of Search ..... 399/34, 35, 53–54, 399/58–61, 120, 343, 344, 358–360; 358/1.8; 347/115, 232

(56) References Cited

U.S. PATENT DOCUMENTS

| | | | | | |
|---|---|---|---|---|---|
| 5,434,652 | A | * | 7/1995 | Fukasawa et al. | 399/54 |
| 5,442,430 | A | * | 8/1995 | Ishii et al. | 399/344 |
| 6,112,046 | A | * | 8/2000 | Suzuki et al. | 399/359 |
| 6,167,211 | A | * | 12/2000 | Oogi et al. | 399/53 |
| 2002/0021913 | A1 | * | 2/2002 | Nakamura et al. | 399/66 |
| 2002/0051664 | A1 | * | 5/2002 | Aoki et al. | 399/359 |

FOREIGN PATENT DOCUMENTS

| | | | | | |
|---|---|---|---|---|---|
| JP | 58-158675 | | | 9/1983 | |
| JP | 05241489 | A | * | 9/1993 | |
| JP | 8-286511 | | | 11/1996 | |
| JP | 9-6202 | | | 1/1997 | |
| JP | 09050163 | A | * | 2/1997 | G03G/15/01 |
| JP | 9-80858 | | | 3/1997 | |
| JP | 09269708 | A | * | 10/1997 | G03G/21/10 |
| JP | 2000-66559 | | | 3/2000 | |
| JP | 2000-89633 | | | 3/2000 | |
| JP | 2001-5243 | | | 1/2001 | |

* cited by examiner

*Primary Examiner*—Susan Lee
(74) *Attorney, Agent, or Firm*—Oblon, Spivak, McClelland, Maier & Neustadt, P.C.

(57) ABSTRACT

An image forming apparatus of the present invention includes a recycle toner conveying device for returning toner collected in a cleaning step to a developing device as recycled toner. A waste toner conveying device conveys the collected toner to a waste toner container as waste toner. A switching device selects either one of the recycle toner conveying device and waste toner conveying device. Toner can therefore be efficiently recycled in accordance with the degree of color mixture of the collected toner. In addition, It is possible to estimate the amount of toner to enter due to reverse transfer and therefore to increase the proportion of toner recycling while reducing the influence of color mixture on the toner to be recycled.

15 Claims, 8 Drawing Sheets

IMAGE FORMING APPARATUS

BACKGROUND OF THE INVENTION

1. Field of the Invention

The present invention relates to a color image forming apparatus for sequentially forming images with a plurality of image forming units and more particularly to a color image forming apparatus capable of recycling collected toners as far as possible to thereby promote effective use of toner.

2. Description of the Background Art

Today, a copier, printer, facsimile apparatus or similar image forming apparatus is often configured to recycle collected toner for saving limited resources. A problem with a full-color image forming apparatus, which uses yellow toner, magenta toner, cyan toner and black toner, is that the toners of different colors are mixed in cleaning units. When more than preselected amounts of toners of different colors are mixed, the tones of colors vary. Further, the toners each having a particular charging characteristic are selectively scattered around. Image quality is therefore degraded unless only toners with low degrees of color mixture are recycled.

Various technologies have heretofore been proposed to recycle collected toners or to dispose of them. However, there has not been proposed a technology for promoting reliable toner recycling by determining whether or not to recycle collected toners and then efficiently selecting recycling or disposal. It is therefore likely that wasted toners contain recyclable toners or that toners not suited for recycling are recycled.

Technologies relating to the present invention are disclosed in, e.g., Japanese Patent Laid-Open Publication Nos. 8-286511, 9-6202, 2000-66559 and 2000-89633.

SUMMARY OF THE INVENTION

It is an object of the present invention to provide an image forming apparatus capable of using only part of collected toners that is suited for recycling.

An image forming apparatus of the present invention includes a recycle toner conveying device for returning toner collected in a cleaning step to a developing device as recycled toner. A waste toner conveying device conveys the collected toner to a waste toner container as waste toner. A switching devices selects either one of the recycle toner conveying device and waste toner conveying device.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
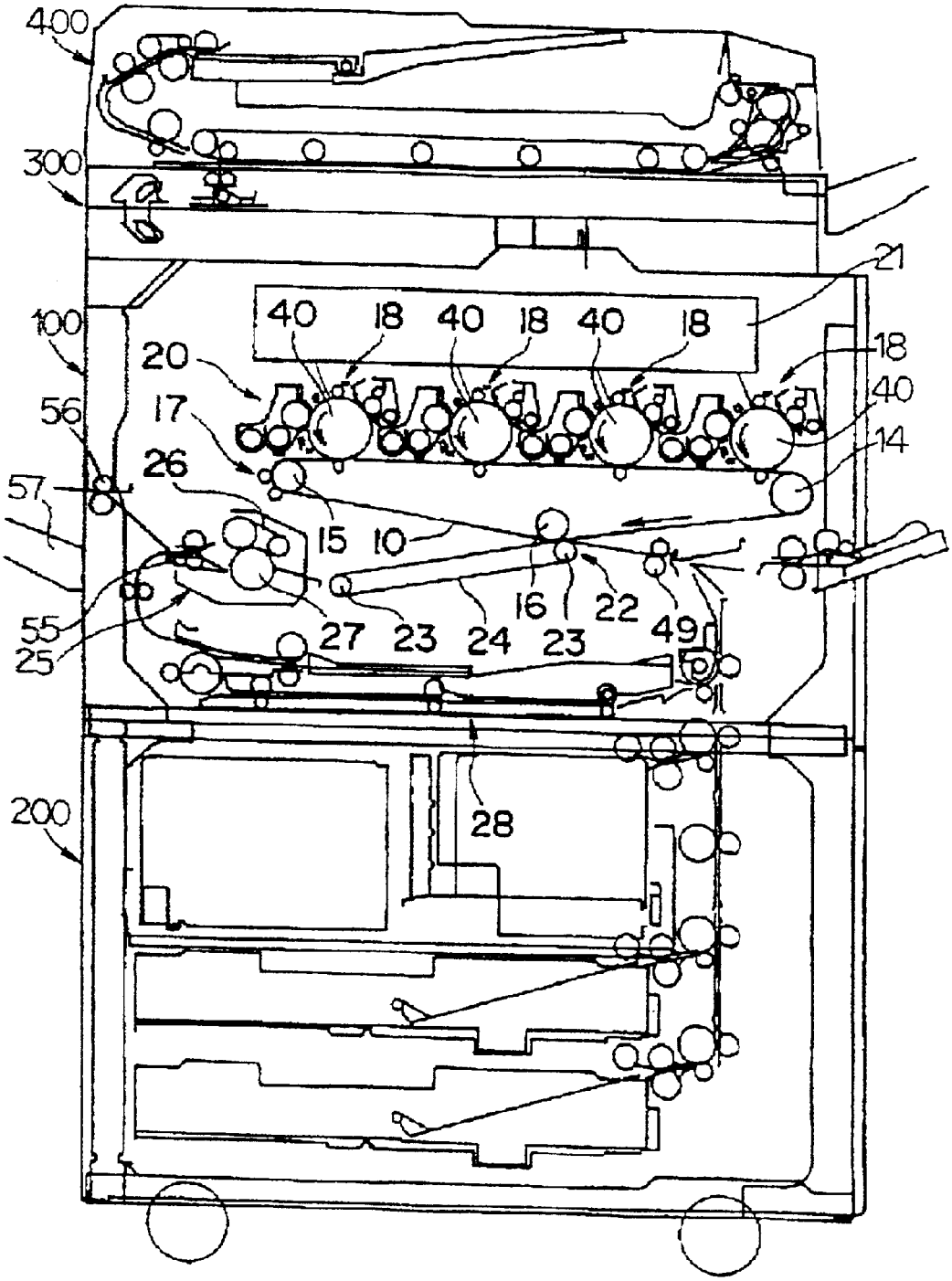
FIG. 1 is a view showing an image forming apparatus embodying the present invention.

Referring to FIG. 1 of the drawings, an image forming apparatus embodying the present invention is shown and implemented as a color copier by way of example. As shown, the color copier is generally made up of a copier body 100, a sheet feed table 200 on which the copier body 100 is mounted, a scanner 300 mounted on the top of the copier body 100, and an ADF (Automatic Document Feeder) 400 mounted on the top of the scanner 300. An intermediate image transfer body 10 is positioned at the center of the copier body 100 and implemented as an endless, intermediate image transfer belt. The intermediate image transfer body (simply belt hereinafter) 10 is passed over three support rollers 14, 15 and 16 and movable clockwise, as viewed in FIG. 1. A belt cleaning device 17 is positioned at the left-hand side of the support roller or second support roller 15 for removing toner left on the belt 10 after image transfer.

A Y (yellow), an M (magenta), a C (cyan) and a Bk (black) image forming unit 18 are arranged side by side above part of the belt 10 extending between the support roller or first support roller 14 and the second support roller 15. The Y, M, C and Bk image forming units 18 are sequentially arranged in this order from the upstream side toward the downstream side in the direction of movement of the belt 10, constituting a tandem image forming mechanism 20. An optical writing unit 21 is positioned above the tandem image forming mechanism 20.

A secondary image transferring device 22 is positioned at the opposite side to the tandem image forming mechanism 20 with respect to the belt 10. The secondary image transferring device 22 includes an endless, secondary image transfer belt (simply belt hereinafter) 24 passed over two rollers 23. The belt 24 is pressed against the support roller or third support roller 16 via the belt 10 and transfers an image from the belt 10 to a sheet or recording medium not shown. A fixing unit 25 is positioned at one side of the secondary image transferring device 22 for fixing the image on the sheet. The fixing unit 25 includes a fixing belt 26 and a press roller 27 pressed against the fixing belt 26.

The secondary image transferring device 22 additionally has a function of conveying the sheet carrying the image thereon to the fixing unit 25. A sheet reversing device 28 is arranged below the secondary image transferring device 22 and fixing unit 25 in parallel with the tandem image forming mechanism 20. In a duplex copy mode, the sheet reversing device 28 reverses the sheet for allowing images to be formed on both sides of the sheet.

When a start switch, not shown, is pressed, a drive motor, not shown, causes one of the support rollers 14 through 16 to rotate while the other support rollers follow the rotation of the one support roller via the belt 10. At the same timer in the Y, M, C and Bk image forming units 18, photoconductive drums (simply drums hereinafter) 40 are rotated to form a Y, an M, a C and a Bk toner image thereon. The Y toner image through Bk toner image are sequentially transferred from the drums 40 to the belt 10 one above the other, completing a full-color image on the belt 10.

A registration roller pair 49 is driven in synchronism with the movement of the full-color image carried on the belt 10 so as to convey a sheet to a nip between the belt 10 and the secondary image transferring device 22. The secondary image transferring device 22 transfers the full-color image from the belt 10 to the sheet. The sheet with the full-color image is conveyed by the secondary image transferring device 22 to the fixing unit 25. The fixing unit 25 fixes the full-color image on the sheet with heat and pressure. In a simplex copy mode, a path selector 55 guides the sheet coming out of the fixing unit 25 toward an outlet roller pair 56. The outlet roller pair 56 discharges the sheet to a copy tray 57. In a duplex copy mode, the path selector 55 is so positioned as to steer the sheet to the sheet reversing device 28. The sheet reversing device 28 reverses the sheet and again delivers it to the nip between the belt 10 and the secondary image transferring device 22, so that another full-color image is formed on the other side of the same sheet. The sheet is then driven out to the copy tray 57 via the path selector 55 and outlet roller pair 56.

After the image transfer, the belt cleaning device 17 removes toner left on the belt 10 to thereby prepare it for the next image formation.

Figure 2:
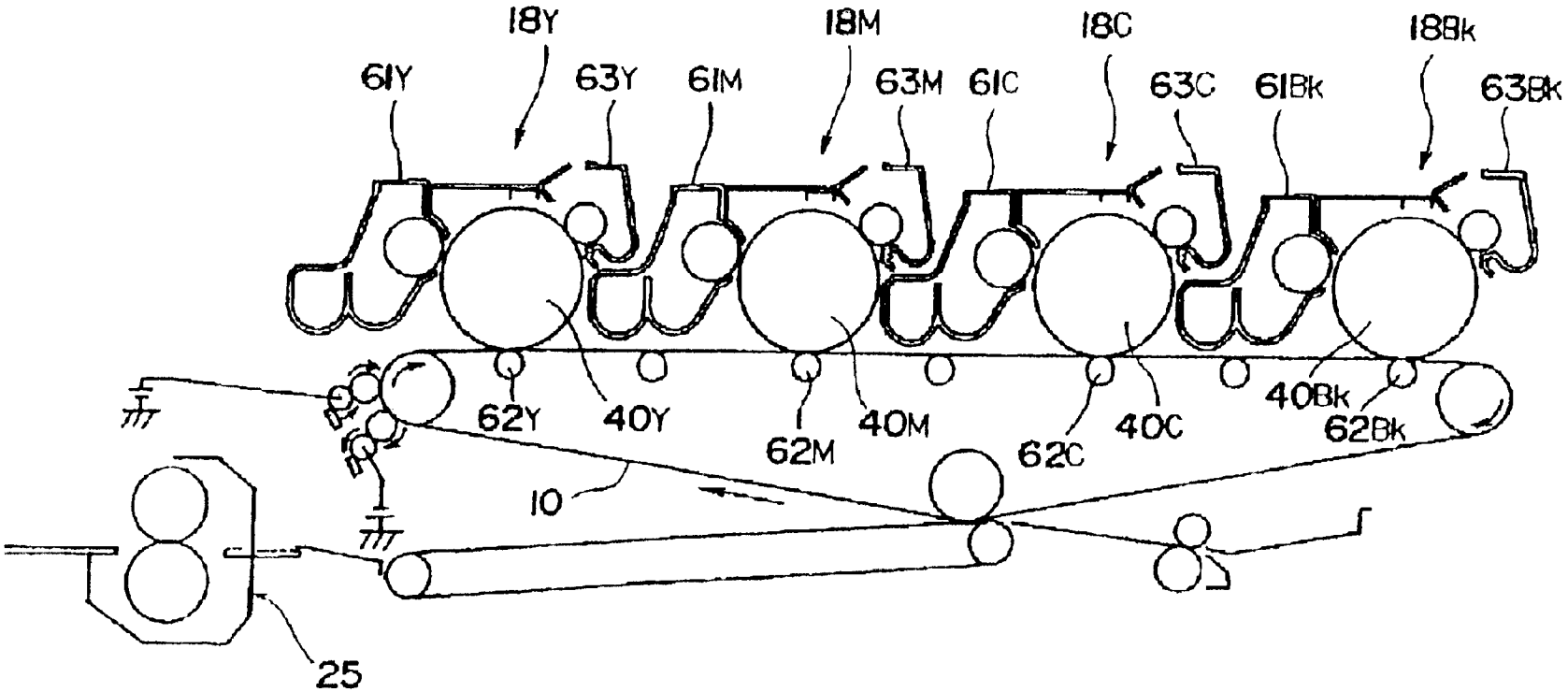
FIG. 2 is a fragmentary view of the illustrative embodiment.
Figure 3:
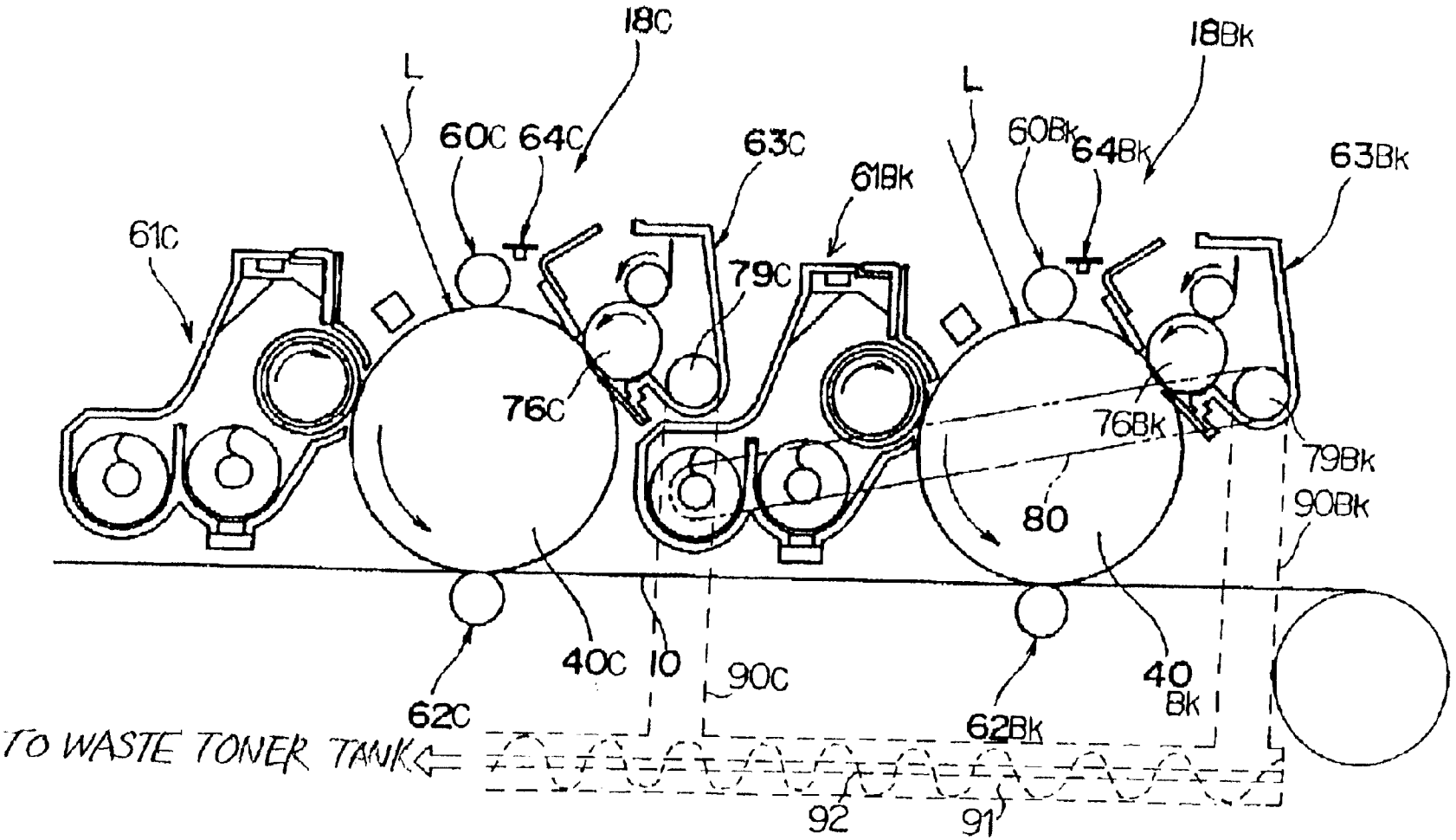
FIG. 3 is an enlarged fragmentary view showing a tandem image forming mechanism shown in FIG. 2.

FIG. 2 shows essential part of the copier body 100 while FIG. 3 shows essential part of the tandem image forming mechanism 20. As shown in FIG. 2, four image forming units 18Y, 18M, 18C and 18Bk are sequentially arranged in this order from the upstream side toward the downstream side of the direction of movement of the belt 10. As shown in FIGS. 2 and 3, the image forming units 18Y through 18Bk include photoconductive drums 40Y through 40Bk, respectively. Arranged around each drum are a charger 60, an optical writing device represented by a light beam L, a developing device 61, a primary image transferring device 62, a cleaning device 63, and a discharger device 64. It is to be noted that such process units arranged around the drums are distinguished from suffixes Y, M, C and Bk. In this configuration, a first copy time in a Bk mode is successfully reduced by the distance between the most upstream drum 40Y and the most downstream drum 40Bk. Further, because the Bk image forming unit 18Bk is remote from the fixing unit or heat source 25, a toner tank with a large capacity, now shown, can be assigned to black, which is used more the other colors. This promotes the free layout of the copier.

As shown in FIG. 3, the cleaning device 63 included in each of the Y, M and C image forming units 18 includes a screw 79 for toner collection. A vertical portion 90 forming part of a waste toner piping is communicated at one end to the rear end of the screw 79, as seen in a direction perpendicular to the sheet surface of FIG. 3, and connected at the other end to a horizontal portion 91 forming the other part of the waste toner piping. Toner collected by the screw 79 drops into the horizontal portion 91 of the piping via the vertical portion 90 due to gravity. A screw conveyor 92 is disposed in the horizontal portion 91 and conveys the above toner to a waste toner tank not shown. The front end of the screw 79, as viewed in the direction perpendicular to the sheet surface of FIG. 3, is communicated to a recycling device 80 (see FIG. 4).

Figure 4:
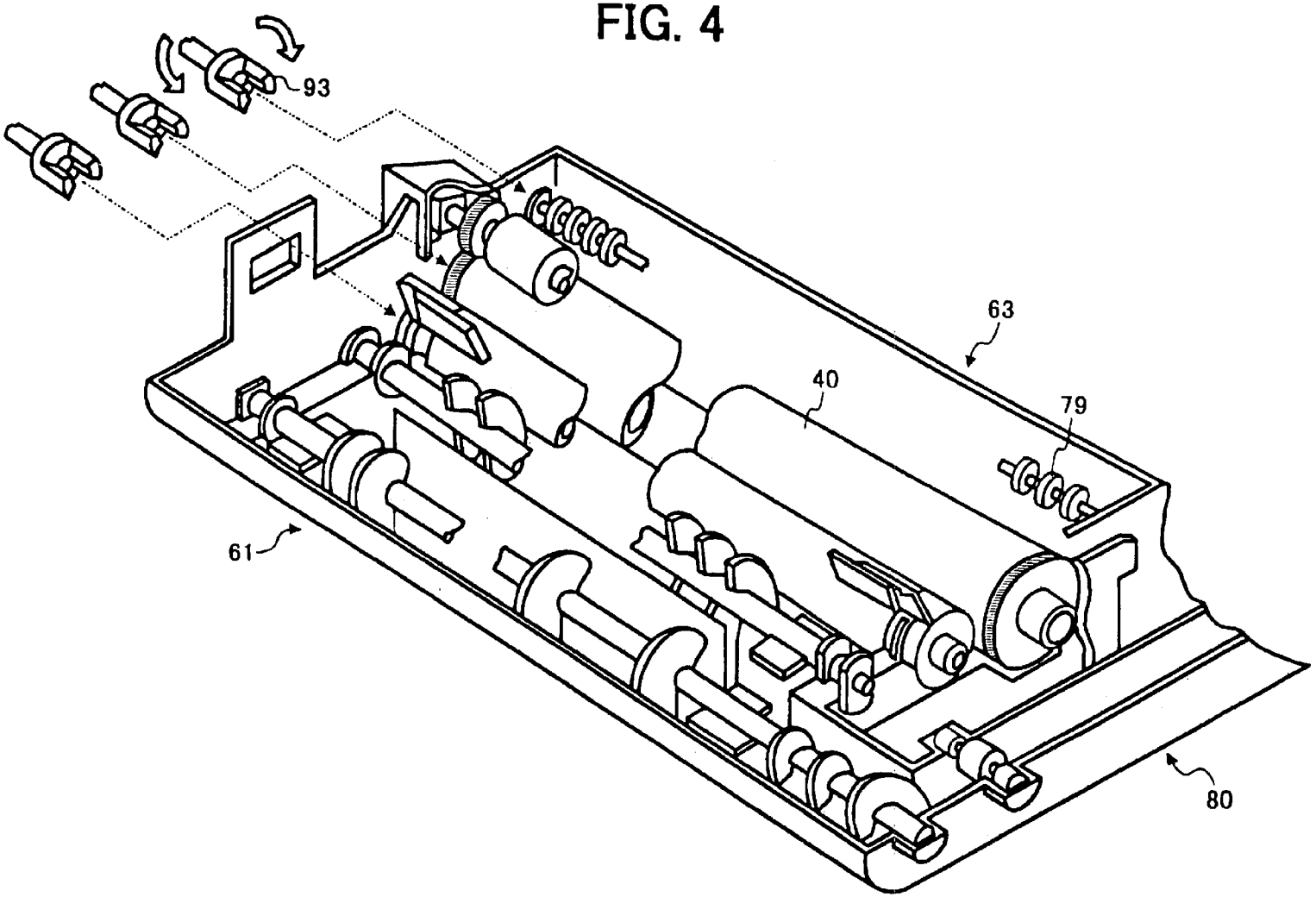
FIG. 4 is a view showing the configuration of an image forming unit included in the tandem image forming mechanism and assigned to black by way of example.

FIG. 4 shows the Bk image forming unit in detail. As shown, the rotation of a cleaning drive shaft, not shown, is transferred to the screw 79 via a coupling 93, causing the screw 79 to rotate. In the illustrative embodiment, the cleaning drive shaft is controlled to selectively rotate in a forward direction or a reverse direction. Therefore, the screw 79 driven by the cleaning drive shaft selectively conveys the toner in the cleaning device 63 toward either one of the front end and rear end.

When the screw 79 conveys the toner toward the front end, the recycling device 80 returns the toner to the developing device 61 as recycled toner. On the other hand, when the screw 79 conveys the toner toward the rear end, the toner drops into the previously stated piping (90 and 91) and conveyed by the screw conveyor 91 to the waste toner tank. A fur brush 76 shown in FIG. 3 is rotated in a preselected direction without regard to the direction of rotation of the screw 79. The drum 40 is drivably connected to the fur brush 76 by gears not shown.

Figure 5:
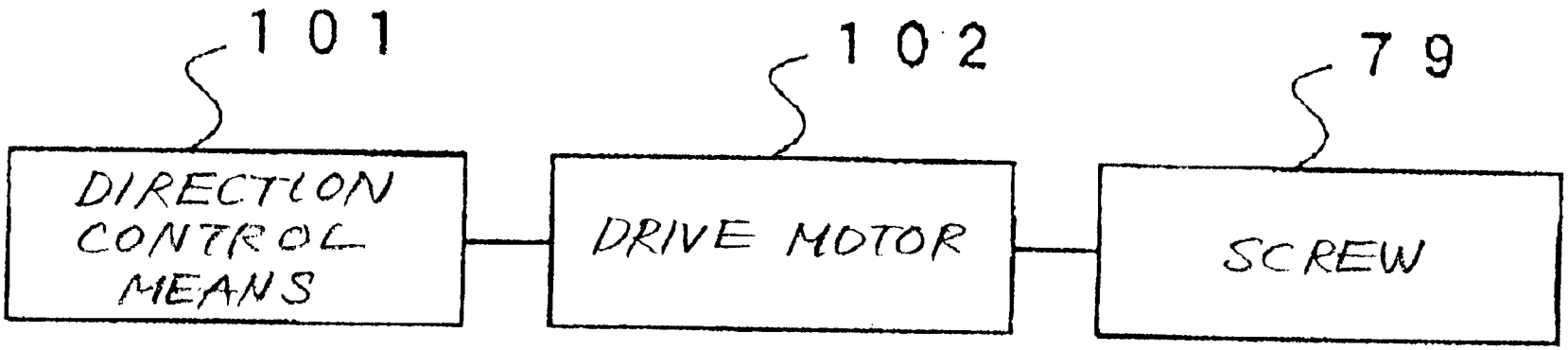
FIG. 5 is a block diagram schematically showing a system for controlling the drive of a screw.

FIG. 5 shows a control system for controlling the rotation of the screw 79 for toner collection. As shown, the control system includes direction control means 101 for controlling the direction of rotation of a drive motor 102. The drive motor 102, in turn, causes the screw 79 to selectively rotate in the forward direction or the reverse direction, as stated above.

Figure 6:
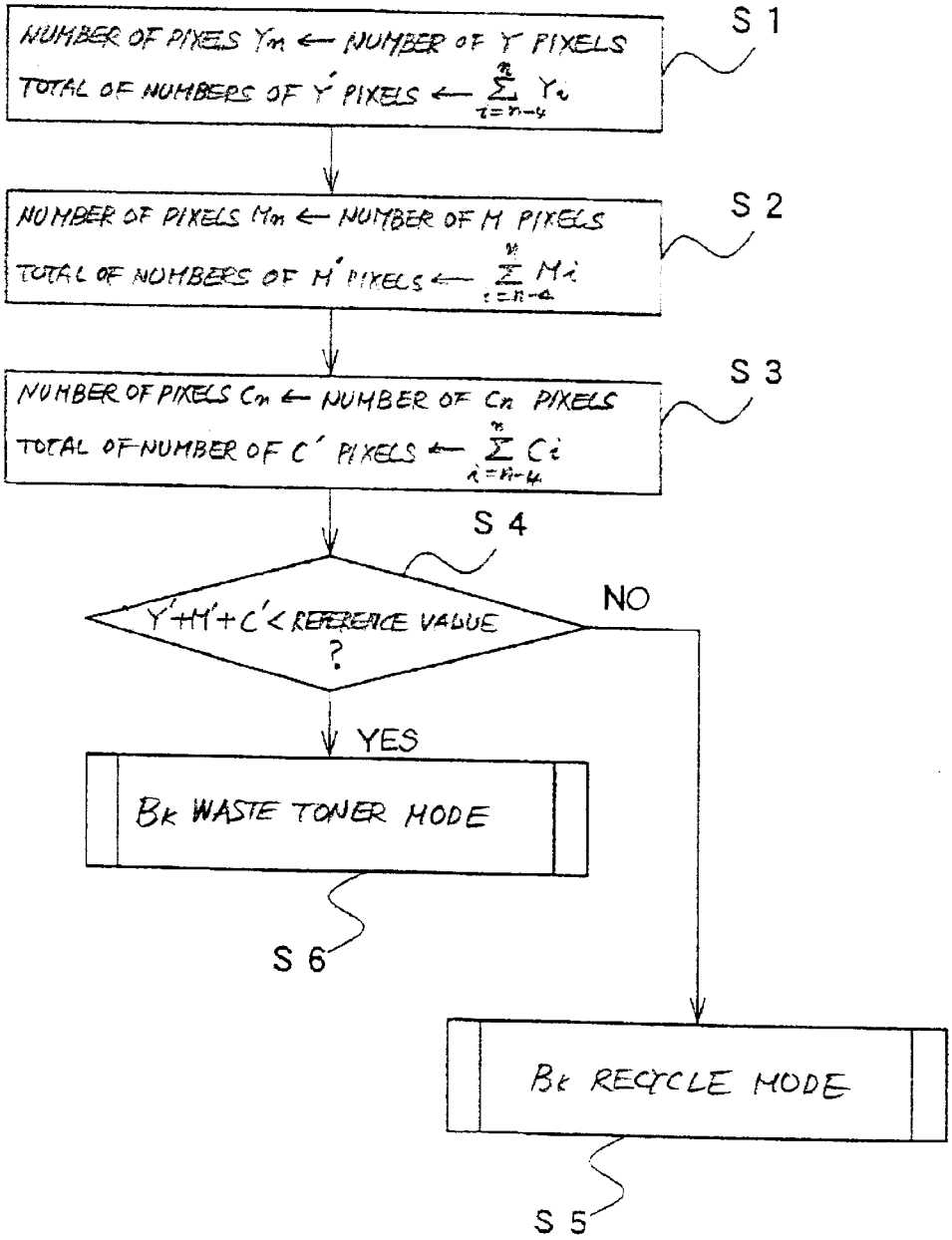
FIG. 6 is a flowchart demonstrating a specific operation of the illustrative embodiment.

FIG. 6 is a flowchart demonstrating, on the assumption that black is the last color, how recycle toner conveying means and waste toner conveying means assigned to the Bk image forming unit 18Bk are selectively operated. In FIG. 6, a decision is made on the number of pixels written over five consecutive times of image formation, i.e., the "n−4" image formation to the "n" image formation at each image forming station. As shown, as for a Y station (Y image forming unit 18Y) positioned upstream of a Bk station (Bk image forming unit 18Bk), the number of pixels Yn−4 written by an image forming cycle four cycles before the current image forming cycle to the number of pixels Yn written by the current image forming cycle are added up to produce a sum Y' (step S1). Such addition is executed with the other colors M and C as well to thereby produce a sum M' (step S2) and a sum C' (step S3).

If the total of the sums Y', M' and C', i.e., Y'+M'+C' is greater than a preselected value (N, step S4), then it is determined that the amounts of Y, M and C toners to enter the Bk cleaning device 63Bk due to reverse transfer increases. In this case, a waste toner mode is selected for selecting the waste toner conveyance path in the Bk cleaning device 63Bk (step S5). As for a Bk mode, while the above number of pixels is basically zero, it may be provided with an offset value in consideration of toner entry ascribable to the background contamination of the other drums. This is the case with an arrangement in which the image transfer sections assigned to the other colors lack moving mechanisms. If the total Y'+M'+C' is smaller than the preselected value (Y, step S4), then a Bk recycle mode is selected (step S6).

The procedure described with reference to FIG. 6 is similarly applicable to the other stations. For example, for a C station, the numbers of pixels written at a Y and an M station upstream of the C station may be determined.

Figure 7:
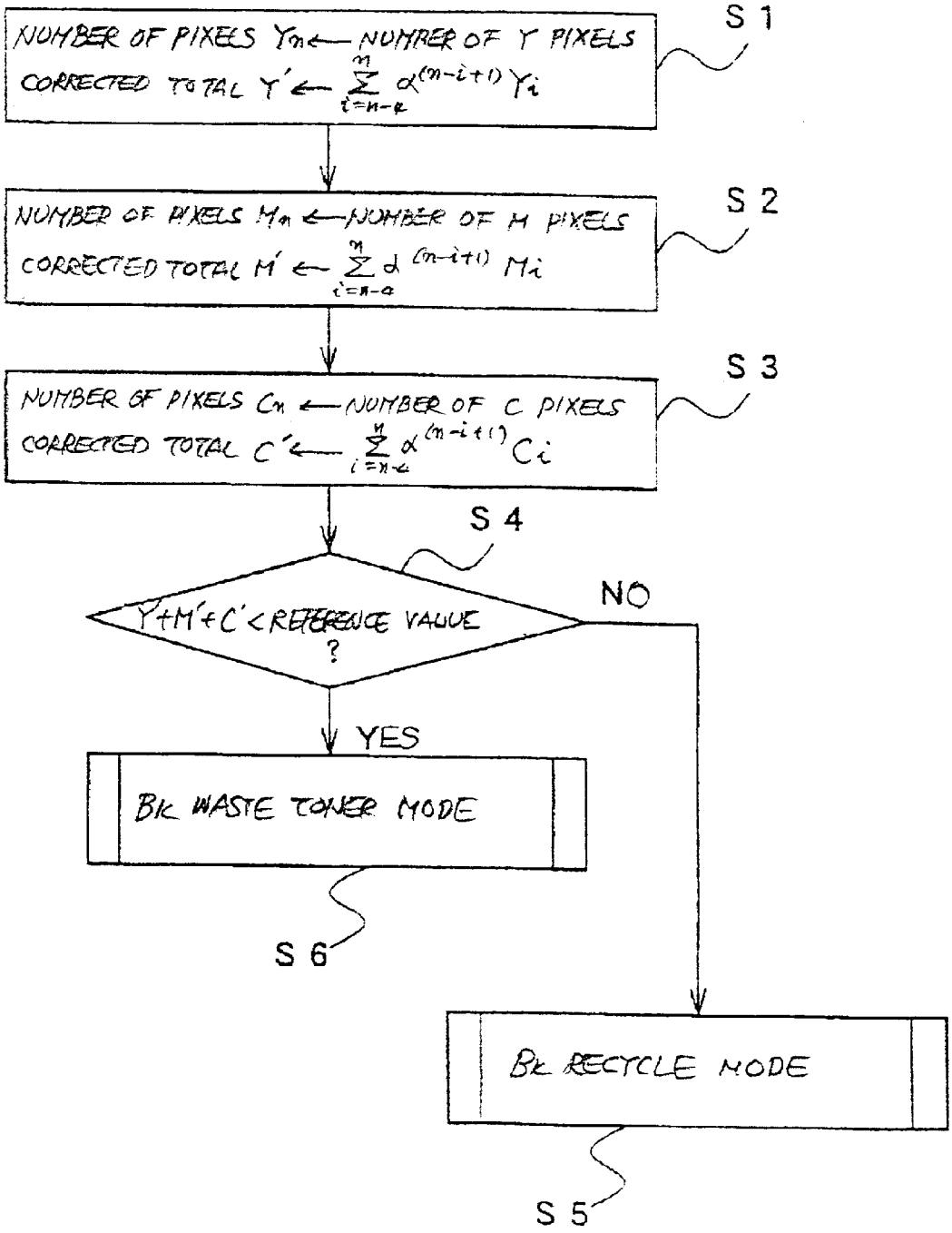
FIGS. 7 and 8 are flowcharts each demonstrating a particular modification of the operation shown in FIG. 6.

FIG. 7 shows a modification of the procedure described with reference to FIG. 6 that uses correction coefficients α. Steps S1 through S6 shown in FIG. 7 are identical with the steps S1 through S6 shown in FIG. 6 except for par thereof relating to the correction coefficients α. As shown, the number of pixels written at each preceding station is multiplied by a correction coefficient α. The correction coefficient α decreases by involution in accordance with how many images have been formed before the time when the number of pixels is determined. The correction coefficient α is selected to be smaller than 1, so that it approaches zero as the multiplier increases. The correction coefficient α shows how much collected toner is discharged from the cleaning device 63 for a single image forming cycle on the basis of the interval between the collection of toner by a blade and the drop of the collected toner into the vertical pipe portion 90 via the screw 79; the toner of the other colors collected by the Bk cleaning device 63Bk before is discharged little by little as the time elapses. The correction using a multiplier may be replaced with correction using a correction table.

Figure 8:
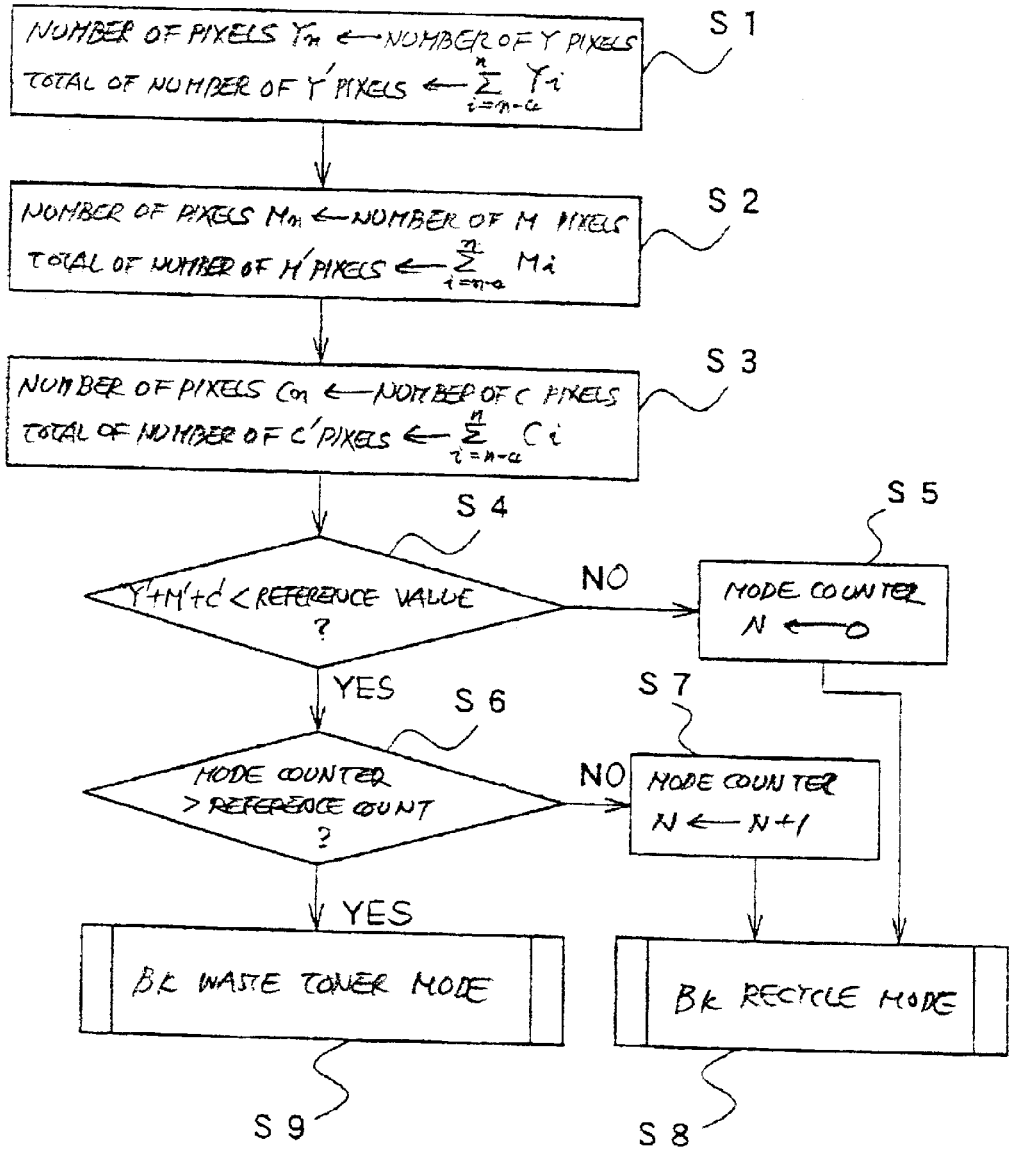

FIG. 8 shows another modification of the procedure described with reference to FIG. 6 that sets a preselected delay at the time of transition form the waste toner mode to the recycle toner mode. As shown, even after the amounts of toners of the other colors to enter the Bk station have decreased, as determined on the basis of the numbers of pixels, the transition from the waste toner mode to the recycle toner mode is not effected until a preselected number of image forming cycles end in consideration of the influence of color mixture on the toner to be recycled. More specifically, a mode counter N counts image forming cycles effected after the reduction of the toners of the other colors to enter the Bk station (steps S5 through S7), so that whether or not to effect the recycle toner mode is determined on the basis of the content of the toner counter N. If desired, the mode counter N may be replaced with a timer counter for counting the drive time of the image forming section. Steps S1 through S4, S8 and S9 shown in FIG. 8 are identical with the steps S1 through S6 shown in FIG. 6 and will not be described specifically.

In FIG. 8, the reference number of image forming cycles on which the above decision is based is fixed. Alternatively, the reference number of image forming cycles may be dynamically corrected by the total of the numbers of pixels (Y'+M'+C'). When the amount of toner of the other colors to enter the Bk station is great, such correction increases the reference value for thereby effect the toner recycle mode after discharge in the waste toner mode has been repeated over a sufficient number of times.

If desired, the transition from the toner recycle mode to the waste toner mode may be delayed in place of the transition from the latter to the former on the basis of the interval stated earlier. This delay increases the amount of toner to be recycled as far as possible. The procedure of FIG. 8 using a preselected delay may alternatively be based on the procedure of FIG. 7 using correction coefficients $\alpha$.

While the illustrative embodiment has concentrated on a tandem image forming apparatus, the switchover between the waste toner mode and the recycle toner mode is similarly applicable to a color image forming apparatus of the type including a single drum, as taught in, e.g., Japanese Patent Laid-Open Publication No. 7-13421. This type of image forming apparatus includes a single drum cleaning device and therefore uses toner of a single color that can be recycled, so that the above switchover is usually applied to Bk development frequently used in practice.

In summary, it will be seen that the present invention provides an image forming apparatus having various unprecedented advantages, as enumerated below.

(1) Toner can be efficiently recycled in accordance with the degree of color mixture of collected toner.

(2) By selecting either one of recycle toner conveying means and waste toner conveying means on the basis of the number of pixels, it is possible to estimate the amount of toner to enter due to reverse transfer and therefore to increase the proportion of toner recycling while reducing the influence of color mixture on the toner to be recycled.

(3) Only the numbers of pixels particular to upstream colors are used for the decision on the switchover, thereby enhancing accurate detection of toners of the other colors as well as efficient toner recycling.

(4) By using a total value derived from the history of a preselected number of times of pixel detection, it is possible to estimate the condition of toners of mixed colors existing in a cleaning device. Therefore, by making the decision on the basis of the total, it is possible to increase the proportion of toner recycling while reducing the influence of color mixture on the toner be recycled.

(5) Correction coefficients are added to the history of a preselected number of times of pixel number detection. It is therefore possible to estimate the condition of toners of mixed colors existing in a cleaning device. Therefore, by making the decision on the basis of the total, it is possible to increase the proportion of toner recycling while reducing the influence of color mixture on the toner to be recycled.

(6) After the decision on the number of pixels, a delay is set that allows toners of mixed colors to be discharged from the cleaning device. This reduces the influence of color mixture on the toner to be recycled.

(7) A Bk image forming unit used more frequently than the other image forming units is positioned at the most downstream side, so that toner to be recycled can be efficiently collected.

Various modifications will become possible for those skilled in the art after receiving the teachings of the present disclosure without departing from the scope thereof.

What is claimed is:

1. A color image forming apparatus comprising:

recycle toner conveying means for returning toner collected in a cleaning step to a developing device as recycled toner;

waste toner conveying means for conveying the toner collected to a waste toner container as waste toner, and switching means for selecting either one of said recycle toner conveying means and said waste toner conveying means based upon a degree of color mixture of collected toner, wherein said switching means is configured such that after a decision on selection, actual switchover between said recycle toner conveying means and said waste toner conveying means is performed after a preselected number of times of image formation or on the elapse of a preselected duration of rotation.

2. The apparatus as claimed in claim 1, wherein said switching means comprises a screw extending between said recycle toner conveying means and said waste toner conveying means and rotatable in opposite directions for conveying the toner collected to either one of said recycle toner conveying means and said waste toner conveying means.

3. The apparatus as claimed in claim 1, further comprising a plurality of image forming units each being assigned to a particularly color, wherein an image forming unit is assigned to black is positioned at a most downstream side in a direction of movement of an intermediate image transfer body of the image forming apparatus.

4. An image forming apparatus comprising:

recycle toner conveying means for returning toner collected in a cleaning step to a developing device as recycled toner;

waste toner conveying means for conveying the toner collected to a waste toner container as waste toner;

switching means for selecting either one of said recycle toner conveying means and said waste toner conveying means; and further comprising a plurality of image forming units each being assigned to a particular color, wherein said switching means selects said recycle toner conveying means or said waste toner conveying means be determining, based on a number of pixels written in another color, whether or not the toner should be recycled.

5. The apparatus as claimed in claim 4, wherein said switching means selects said recycle toner conveying means or said waste toner conveying means in accordance with a total number of pixels written over a preselected number of times of image formation.

6. The apparatus as claimed in claim 4, wherein said switching means selects said recycle toner conveying means or said waste toner conveying means in accordance with a total of values produced by multiplying the numbers of pixels by correction coefficients.

7. The apparatus as claimed in claim 4, wherein after a decision on selection, actual switchover between said recycle toner conveying means and said waste toner conveying means is performed after a preselected number of times of image formation or on the elapse of a preselected duration of rotation.

8. The apparatus as claimed in claim 7, wherein the preselected number of times of image formation or the preselected duration of rotation is variable in accordance with a total of the numbers of pixels written over a preselected number of times of image formation.

9. The apparatus as claimed in claim 7, wherein the preselected number of times of image formation or the preselected duration of rotation is variable in accordance with a total of values produced by multiplying the numbers of pixels by correction coefficients.

10. An image forming apparatus comprising:

recycle toner conveying means for returning toner collected in a cleaning step to a developing device as recycled toner;

waste toner conveying means for conveying the toner collected to a waste toner container as waste toner;

switching means for selecting either one of said recycle toner conveying means and said waste toner conveying means; and further comprising a plurality of image forming units each being assigned to a particular color, wherein said switching means selects either one of said recycle toner conveying means and said waste toner conveying means in accordance with a number of pixels written in a color upstream of a color which is a subject of decision as to whether or not to recycle.

11. The apparatus as claimed in claim 10, wherein said switching means selects said recycle toner conveying means or said waste toner conveying means in accordance with a total number of pixels written over a preselected number of times of image formation.

12. The apparatus as claimed in claim 10, wherein said switching means selects said recycle toner conveying means or said waste toner conveying means in accordance with a total of values produced by multiplying the numbers of pixels by correction coefficients.

13. The apparatus as claimed in claim 10, wherein after a decision on selection, actual switchover between said recycle toner conveying means and said waste toner conveying means is performed after a preselected number of times of image formation or on the elapse of a preselected duration of rotation.

14. The apparatus as claimed in claim 13, wherein the preselected number of times of image formation or the preselected duration of rotation is variable in accordance with a total of the numbers of pixels written over a preselected number of times of image formation.

15. The apparatus as claimed in claim 13, wherein the preselected number of times of image formation or the preselected duration of rotation is variable in accordance with a total of values produced by multiplying the numbers of pixels by correction coefficients.

* * * * *